US008803894B2

(12) United States Patent
Shivji

(10) Patent No.: US 8,803,894 B2
(45) **Date of Patent: *Aug. 12, 2014**

(54) OBJECT IDENTIFIER

(75) Inventor: Shane Shivji, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 2939 days.

This patent is subject to a terminal disclaimer.

(21) Appl. No.: 11/105,903

(22) Filed: Apr. 14, 2005

(65) Prior Publication Data

US 2006/0235546 A1 Oct. 19, 2006

(51) Int. Cl.

| | |
|---|---|
| ***G06T 1/60*** | (2006.01) |
| ***G06F 3/041*** | (2006.01) |
| ***G09G 5/00*** | (2006.01) |
| ***G06F 3/033*** | (2013.01) |

(52) U.S. Cl.
USPC ..... 345/530; 345/156; 345/158; 345/173

(58) Field of Classification Search
USPC ..... 273/317.6; 345/156, 158, 173, 326, 345/530; 434/118, 169, 327; 700/1; 701/156, 300; 715/719; 463/1
See application file for complete search history.

(56) References Cited

U.S. PATENT DOCUMENTS

| | | | | |
|---|---|---|---|---|
| 4,112,421 | A | 9/1978 | Freeny, Jr. | |
| 4,660,141 | A | 4/1987 | Ceccon et al. | |
| 5,129,654 | A | 7/1992 | Bogner | |
| 5,216,234 | A | 6/1993 | Bell | |
| 5,467,082 | A | 11/1995 | Sanderson | |
| 5,590,217 | A | 12/1996 | Toyama | |
| 5,635,907 | A | 6/1997 | Bernard et al. | |
| 5,760,916 | A | 6/1998 | Dellert et al. | |
| 5,768,561 | A | 6/1998 | Wise | |
| 5,823,872 | A | 10/1998 | Prather et al. | |
| 5,841,662 | A | 11/1998 | Cook et al. | |
| 5,991,693 | A * | 11/1999 | Zalewski | 701/300 |
| 6,018,776 | A | 1/2000 | Wise et al. | |
| 6,036,101 | A | 3/2000 | Hass et al. | |
| 6,067,417 | A | 5/2000 | Wise et al. | |
| 6,079,009 | A | 6/2000 | Wise et al. | |
| 6,330,977 | B1 | 12/2001 | Hass et al. | |
| 6,353,888 | B1 | 3/2002 | Kakehi et al. | |
| 6,393,140 | B1 | 5/2002 | Itako | |
| 6,442,986 | B1 | 9/2002 | Russell et al. | |
| 6,449,718 | B1 | 9/2002 | Rucklidge et al. | |
| 6,480,108 | B2 | 11/2002 | McDonald | |
| 6,571,339 | B1 | 5/2003 | Danneels et al. | |
| 6,688,449 | B1 | 2/2004 | Yamagishi | |
| 6,779,718 | B1 | 8/2004 | Wlodarczyk | |
| 6,835,131 | B1 * | 12/2004 | White et al. | 463/1 |
| 7,397,464 | B1 * | 7/2008 | Robbins et al. | 345/173 |
| 2001/0000014 | A1 * | 3/2001 | Ishihara et al. | 273/317.6 |

* cited by examiner

*Primary Examiner* — Jeffrey Chow

(57) ABSTRACT

A method and apparatus record a first object identifier in a memory associated with an object and record a second object identifier in the memory in place of the first object identifier.

8 Claims, 5 Drawing Sheets

OBJECT IDENTIFIER

BACKGROUND

Some electronic devices have applications which utilize multiple objects such as game pieces, tokens and the like. To communicate with the objects and to distinguish the objects from one another, permanent identifiers or addresses are affixed to each object at manufacture. However, this may result in the exchange or replacement of objects being more difficult.

DETAILED DESCRIPTION OF EXAMPLE EMBODIMENTS

Figure 1:
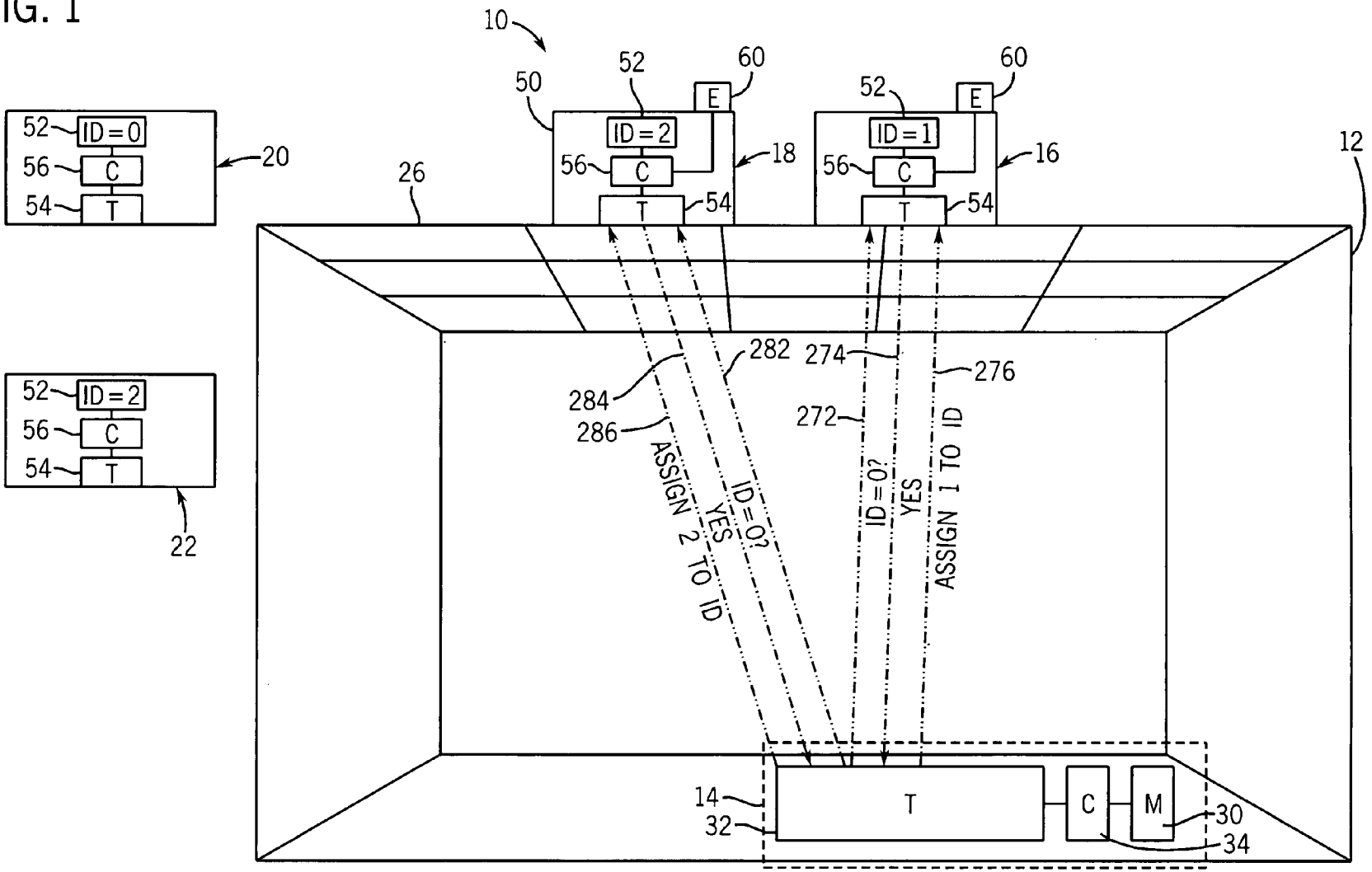
FIG. 1 is a schematic illustration of an embodiment of an object identification and control system during assignment of object identifiers to objects according to one exemplary embodiment.

FIG. 1 schematically illustrates object identification and control system 10 configured to dynamically assign identifiers to distinct objects. System 10 generally includes main unit 12, identifier assignment system 14 and objects 16, 18, 20 and 22. Main unit 12 comprises a base unit configured for use with each of objects 16, 18, 20 and 22 in one or more applications. In one embodiment, base unit 12 provides a surface 26 upon which objects 16-22 may be placed and may interact with one another in the application. In the particular embodiment shown, base unit 12 additionally houses assignment system 14. In other embodiments, assignment system 14 may be provided external to base unit 12.

Assignment system 14 generally comprises a host system configured to dynamically assign one or more unique or distinct identifiers or addresses to objects 16-22 as such objects 16-22 being used in an application such as a game, program or the like. Assignment system 14 includes memory 30, transceiver 32 and controller 34. Memory 30 comprises a data storage mechanism configured to store data transmitted from controller 34. In the embodiment shown, memory 30 comprises memory configured to store assignments of identifiers to objects 16-22. Memory 30 may comprise a random access memory (RAM), a EEROM memory, a mass storage device or some other persistent storage. Memory 30 is configured to be read or otherwise accessed by controller 34.

Transceiver 32 comprises an electronic device configured to communicate with objects 16-22. In the embodiment shown, transceiver 32 incorporates both a transmitter for transmitting or sending signals to objects 16-22 and a receiver for receiving communication signals from objects 16-22. In other embodiments, assignment system 14 may alternatively include a transmitter that is separate and distinct from a receiver. In one embodiment, transceiver 32 may be configured to transmit and receive optical signals such as infrared or visible light. In other embodiments, transceiver 32 may be configured to transmit and receive radio frequency signals as well as other forms of signals.

Controller 34 comprises a processing unit. For purposes of this disclosure, the term "processing unit" shall mean a processing unit that executes sequences of instructions contained in a memory (a processor readable medium), such as memory 30 or an alternative memory (not shown). Execution of the sequences of instructions causes the processing unit to perform steps such as generating control signals. Controller 34 is not limited to any specific combination of hardware circuitry and software, nor to any particular source for the instructions executed by the processing unit.

Controller 34 is configured to assign identifiers to objects based upon signals received from such objects via transceiver 32 and to generate control signals causing transceiver 32 to communicate or transmit the assigned identifiers to the respective objects 16-22. As will be described in greater detail hereafter, objects 16-22 record the assigned identifier which is later used in distinguishing objects 16-22 from one another when being used in a particular application.

Objects 16-22 comprise individual units configured for use with main unit 12 as part of an application such as a game, program or the like. In one embodiment, objects 16-22 interact with one another or are interacted with one another as part of an application. In one embodiment, objects 16-22 may comprise game pieces or tokens. Examples of game pieces include chess pieces and checker pieces. In the particular example shown, each of objects 16-22 is identical to one another and includes a body 50, memory 52, transceiver 54 and controller 56, all of which are schematically shown. Body 50 generally comprises a structure which provides each object 50 which is with its shape and general appearance. Body 50 houses memory 52, transceiver 54 and controller 56. Depending upon the application, body 50 may have various configurations such as a round checkers piece, the shape of a chess pawn and the like. In the particular example shown, each body is configured to rest upon surface 26 of main unit 12. For example, in one embodiment, surface 26 may comprise a chessboard or checkerboard while objects 16-22 comprise chess or checker pieces.

Memory 52 comprises a memory configured to be repeatedly written or recorded upon for storing an object identifier. For purposes of this disclosure, the term "object identifier" shall mean any identification scheme such as symbols, numbers, patterns, codes, names or other indicia that may be assigned to an object for identifying and addressing the object. Memory 52 is contained within body 50 and comprise a random access memory (RAM), a EEROM memory, a mass storage device or some other persistent storage. Memory 52 is configured to be accessed by controller 56.

Transceiver 54 comprises an electronic device configured to communicate with assignment system 14. In the embodiment shown, transceiver 54 operates as both a transmitter for transmitting or sending signals and a receiver for receiving signals. In other embodiments, each object 16-22 may include a separate receiver and transmitter.

Controller 56 is housed within body 50 and comprises a processing unit configured to record an object identifier, assigned by and communicated to transceiver 54 by assignment system 14, in memory 52. In one embodiment, controller 56 is configured to overwrite any existing object identifier in memory 52 with a newly assigned object identifier. In another embodiment, controller 56 is configured to first erase any object identifier within memory 52 before recording the newly assigned object identifier in memory 52.

FIG. 1 further illustrates one example scenario for object identification system 10. In particular, FIG. 1 illustrates objects 16 and 18 resting upon surface 26 and being used as part of an application. At the same time, objects 20 and 22 are depicted as being withdrawn from surface 26 and not be used as part of the application. Because objects 20 and 22 are not in use or not "in play", each of objects 20 and 22 has a null object identifier (ID) having a value of zero. In the example shown, the null object identifier value indicates that objects 20 and 22 have not been assigned a distinct object identifier value. In other embodiments, other object identifiers, other values or an omission of any values or identifiers may be utilized to indicate or represent that a particular object is "out of play" or has not been assigned a distinct object identifier. In the particular embodiment shown, each of objects 16-22 may be manufactured and provided with a "null" object identifier, such as zero, representing or indicating that the particular object has not been specifically assigned a distinct object identifier or address by assignment system 14.

As further shown by FIG. 1, once an object is brought into play or is used in a particular application, assignment system 14 assigns a distinct object identifier to each object. This distinct object identifier is used to distinguish between objects that are in play and to separately address or communicate with such objects. In the example shown, assignment system 14 has assigned object 16 with an object identifier value of 1 and has assigned object 18 with an object identifier value of 2. Values 1 and 2 are merely examples of numeric object identifiers. In other embodiments, objects 16 and 18 may alternatively be assigned other object identifiers that are distinct from one another such as distinct patterns, colors, codes, words and the like. When assignment system 14 assigns a new object identifier to an object newly placed in use, the former null object identifier (zero in the example) is erased and replaced or overwritten.

Overall, object identification system 10 enables objects 16-22 to be dynamically assigned unique or distinct identifiers which enable objects 16-22 to be distinguished from one another and to be individually issued commands as part of an application, program and the like. Because the assignment of an object identifier to a particular object occurs when the object is placed in use as part of an application, rather than at the time of manufacture of the particular object, each object 16-22 may be assigned an identifier based in part upon object identifiers already assigned to other objects that are also being used as part of the application. For example, objects 16 and 18 have object identifier values of 1 and 2, respectively. Upon its introduction as a new object, object 20 may be assigned an object identifier value of 3 to distinguish it from objects 16 and 18. If object 20 is withdrawn from use in the application and replaced by object 22, object 22 may be assigned an object identifier value of 3 or 4. The described dynamic assignment scheme facilitates the exchange or addition or new objects in an application with a reduced likelihood that the new object or replacement object will have an object identifier similar to an object identifier already assigned to another object.

Figure 2B:
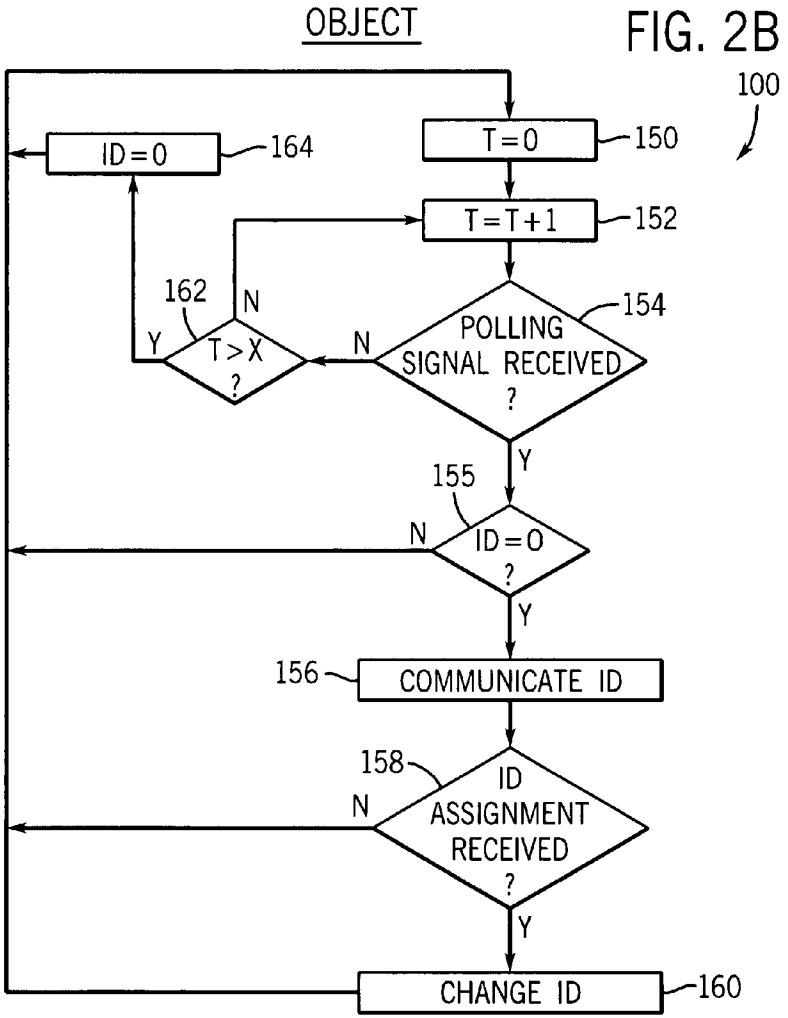
FIG. 2B is a flow chart illustrating an example process carried out by an object of the system of FIG. 1 according to one exemplary embodiment.
Figure 2A:
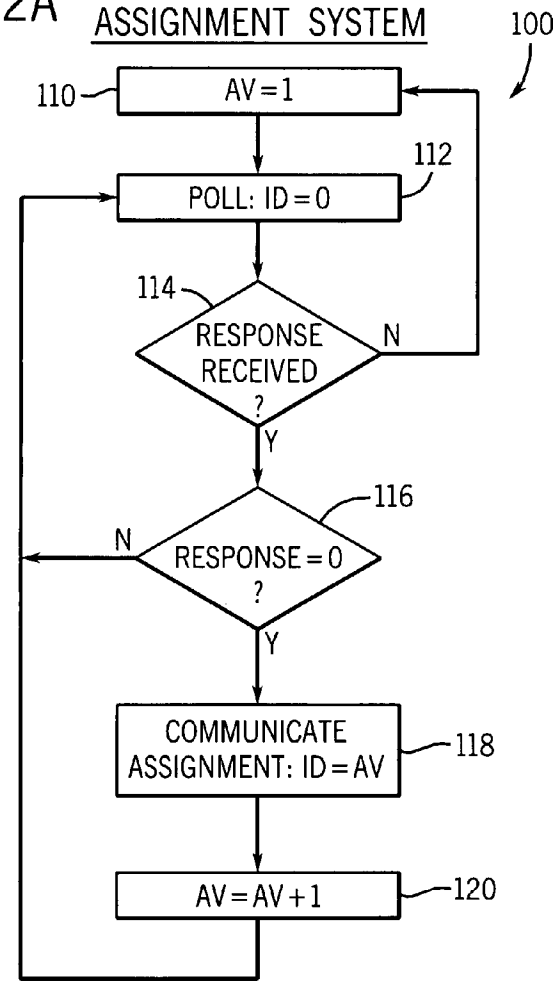
FIG. 2A is a flow chart illustrating an example process carried out by an assignment system of the system of FIG. 1 according to one exemplary embodiment.

FIGS. 2A and 2B illustrate one example of a particular assignment scheme 100 that may be used by assignment system 14 and objects 16-22 (shown in FIG. 1). FIG. 2A is a flow chart illustrating steps performed by assignment system 14 (shown in FIG. 1) in one embodiment. FIG. 2B is a flow chart illustrating steps performed by each object 16-22 in one embodiment. In particular, FIG. 2A illustrates a sequence of steps stored in memory 30 or stored in an alternative memory (not shown) to be carried out by controller 34. As indicated by step 110, an assignment value is initially set as one, a value distinct from a null object identifier value of zero. As indicated by step 112, controller 34 (shown in FIG. 1) generates control signals directing transceiver 32 to transmit signals or commands to objects within a predetermined range or spatial positioning with respect to system 14, such as when objects are placed upon surface 26, inquiring as to whether the objects have the null object identifier value (zero in the example). According to one exemplary embodiment, controller 34 generates control signals directing transceiver 32 to send a command to any and all objects having the null object identifier value. Each object in use as part of the application is commanded to respond regardless of whether the particular object has a null object identifier or has been assigned a distinct object identifier.

As indicated by step 114, controller 34 waits for any response from any of objects 16-22. If no responses are received, indicating that no objects are currently actuated and in use as part of the application, the assignment value is reset to one per step 110. Alternatively, if a response is received from at least one object being used as part of an application, controller 34 evaluates each response as indicated by step 116. For each response indicating that a particular object has a null object identifier (zero in the example), controller 34 generates control signals directing transceiver 32 to communicate or transmit signals assigning the current assignment value (AV) to the particular object as its address or object identifier (ID) as indicated by step 118.

As indicated by step 120, the assignment value AV is incremented by 1 so that each object is assigned a distinct value for its object identifier. Once an assignment value has been assigned and communicated per step 118 and the assignment value has been incremented per step 120, controller 34 generates control signals directing transceiver 34 to continue to poll for the identification of the object identifiers of any new objects introduced into an application. If none of the received responses identify an object having a null object identifier value, assignment of an assignment value AV is not made and polling for new objects introduced in an application continues per step 112.

FIG. 2B illustrates a series or sequence of steps to be carried out by controller 56 of each object 16-22. Such steps or instructions are stored in memory 52 or in an alternative memory (not shown) associated with each object. As indicated by steps 150 and 152, controller 56 includes a timer or counter which is initialized or reset at zero and tracks elapsed time as indicated in step 152. As indicated by step 154, each object 16-22 continually monitors the reception of polling signals from assignment system 14. As indicated by step 155, once a polling signal has been received, controller 56 accesses memory 52 to determine the current object identifier or address assigned to the object. If the current assigned object identifier value in memory 52 is not a null value (a non-zero value in the example shown), controller 56 resets the counter per step 150 and continues monitoring the reception of polling signals per step 154. If the current object identifier value in memory 52 is a null value (zero in the example), controller 56 generates control signals directing transceiver 54 to communicate the current object identifier value to assignment system 14 as indicated by step 156. As indicated by step 158, once the existing object identifier value has been communicated per step 156, controller 56 monitors signals from assignment system 14 and awaits reception of a new assigned value AV for its object identifier. As indicated by step 160, upon receiving a signal indicating the assigned value AV, controller 56 changes the object identifier value stored in memory 52 to the newly assigned value. In one embodiment, controller 56 overwrites the null object identifier value (zero in the example) with the new object identifier value. In another embodiment, controller 56 first erases the null object identifier value and writes the new object identifier value in its place. Once the new object identifier value has been recorded in memory 52, the counter is reset as indicated by step 150.

As indicated by step 162, controller 56 repeatedly evaluates the amount of time that is elapsed since the time at which the last polling signal from assignment system 14 has been received. As indicated by step 164, if the amount of elapsed time since receipt of the last polling signal exceeds a predetermined value X, controller 56 records the null object identifier value (zero in the example) in memory 52 in place of the previously stored object identifier value. In essence, should an object be withdrawn from use in an application, the object will no longer receive polling signals from assignment system 14. In such circumstances, each object 16-22 will automatically reset the stored object identifier value to the null value. Thus, the polling signals from assignment system 14 also serve as renewal signals which cause controller 56 to maintain the currently stored object identifier value in memory 52. In other embodiments, other signals may be used as renewal signals in lieu of the polling signals. Upon its reintroduction into a particular application, the particular object will be assigned a new object identifier value by assignment system 14 per the steps depicted in FIG. 2A.

FIG. 1 illustrates one example scenario under the assignment schemes depicted in FIGS. 2A and 2B. In the example scenario, object 16 is first introduced into the application by being placed upon surface 26. Upon being introduced to the application, object 16 has the null object identifier value of zero. Assignment system 14 polls object 16 by transmitting signal 272 asking object 16 whether its object identifier has the null value of zero. Object 16 responds by communicating a signal 274 indicating that its object identifier value is the null value of zero. As a result, assignment system 14 assigns an object identifier value of one and communicates the assigned value of one to object 16 with signal 276. In response to receiving the new ID assignment, controller 56 of object 16 records the new object identifier value of 1 in memory 52 in place of the previously stored null object identifier value of zero per step 160 in FIG. 2B.

FIG. 1 further illustrates a subsequent introduction of object 18 into the application by being placed upon surface 26. Per step 112 in FIG. 2A, assignment system 14 continues to poll all objects introduced into the application. In the particular example shown, assignment system 14 communicates signal 282 asking object 18 whether it has the null object identifier value of zero. Since object 18 is being introduced into the application, it has the null object identifier value of zero and responds as such by transmitting signal 284 to assignment system 14. As a result, assignment system 14 assigns a new object identifier value AV (which has been incremented by one to a value of 2 per step 120 shown in FIG. 2A) and communicates the new object identifier value of 2 to object 18 with signal 286. In response to receiving the new ID assignment, controller 56 of object 18 records the new object identifier value of 2 in memory 52 in place of the previously stored null object identifier value of zero per step 160 shown in FIG. 2B.

In particular circumstances, objects 16 and 18 may be nearly simultaneously introduced to an application by being nearly simultaneously placed upon surface 26. In one embodiment, controller 34 is configured to poll for the introduction of new objects and to communicate newly assigned object identifiers to newly introduced objects at a sufficiently high frequency such that no two introduced objects both respond to assignment system 14 that they each have recorded in memory 52 the null object identifier value. In one embodiment, controller 34 is configured to poll for newly introduced objects at a frequency of at least once every 10 microseconds. In another embodiment, controller 34 is configured to poll for newly introduced objects at a frequency of at least once every 10 milliseconds. In other embodiments, assignment system 14 may alternatively be configured to poll for the introduction of objects at lesser frequencies or even greater frequencies.

In particular applications where object identifiers are being rapidly assigned to newly introduced objects, each controller 56 of each object may be additionally configured to generate control signals directing an indicator 60 to indicate completion of the recordation of a new object identifier. For example, in one embodiment, indicator 60 may comprise visual indicators such as an LED, wherein the LED is lit once the associated object has been properly recognized by assignment system 14 and has been assigned a distinct object identifier that has been recorded in memory 52. In another embodiment, indicator 60 may comprise an audible indicator, wherein controller 56 causes the audible indicator to emit a sound indicating that the associated object has been recognized and assigned a distinct object identifier by assignment system 14 that has been recorded in the memory of the particular object. In still other embodiments, indicator 60 may be configured to emit other forms of signals other than visual or auditory signals.

Figure 3C:
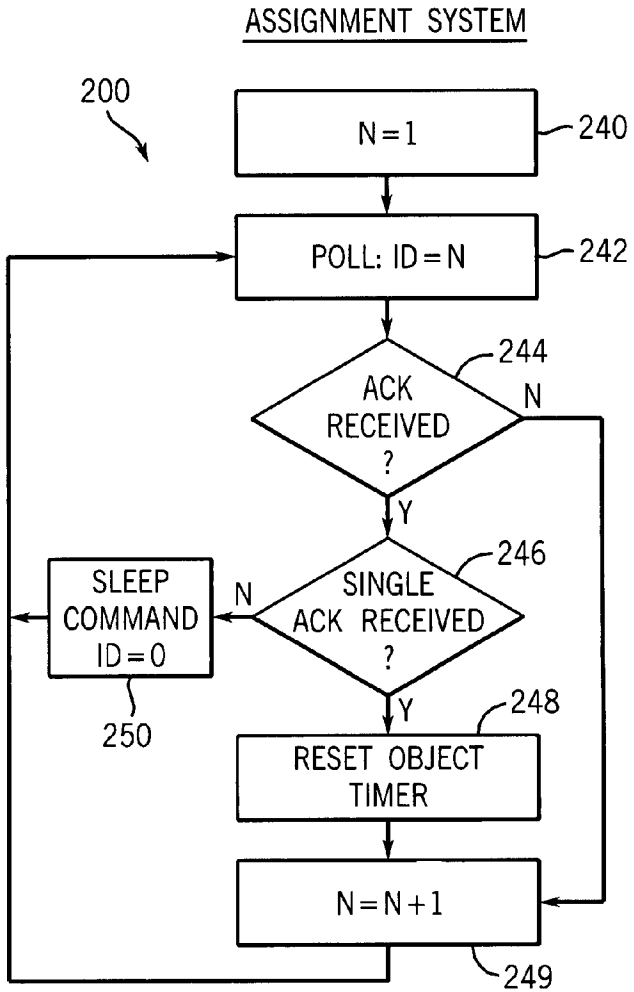
FIG. 3C is a flow chart illustrating another example process carried out by the assignment system of FIG. 1 according to one exemplary embodiment.
Figure 3B:
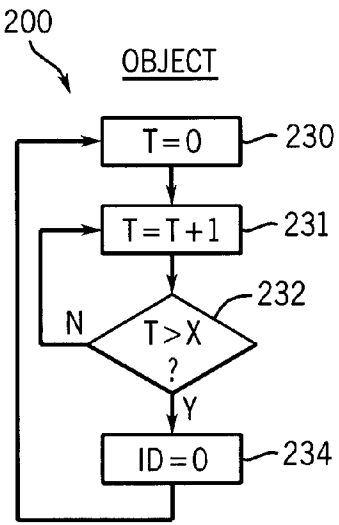
FIG. 3B is a flow chart illustrating another example process carried out by an object of the system of FIG. 1 according to one exemplary embodiment.
Figure 3A:
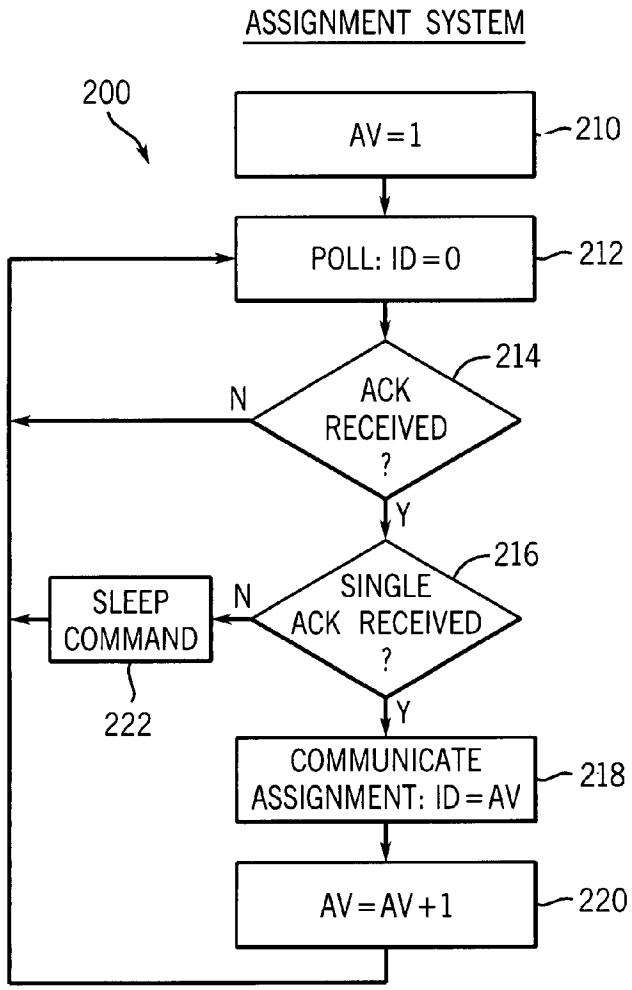
FIG. 3A is a flow chart illustrating another example process carried out by the assignment system of FIG. 1 according to one exemplary embodiment.

FIGS. 3A, 3B and 3C illustrate assignment scheme 200, another embodiment of assignment scheme 100 that may be used by assignment system 14 and objects 16-22 (shown in FIG. 1). FIGS. 3A and 3B are flow charts illustrating steps performed by assignment system 14 (shown in FIG. 1) according to one embodiment. FIG. 3A illustrates steps performed by assignment system 14 to assign an address or object identifier (ID) to objects. As indicated in step 210, an assignment value (AV) is initially set as 1, a value distinct from a null object identifier value of 0. As indicated by step 212, controller 34 (shown in FIG. 1) generates control signals directing transceiver 32 to transmit commands to any and all objects within a predetermined range or spatial positioning with respect to system 14, having the null object identifier value of 0 and requesting that such objects transmit a response or acknowledgment (ACK). According to one exemplary embodiment, objects are polled every 10 micro seconds. In other embodiments, polling may occur at other time intervals. As indicated by step 214, controller 34 waits for any response from any of objects 16-22. If no responses or acknowledgments are received, indicating that either no objects are currently actuated or in use as part of the application or that all objects have been assigned an active object identifier (not the null object identifier), assignment system 14 continues to poll. Alternatively, if a response or acknowledgment is received, assignment system 14 next determines whether a single acknowledgment or multiple acknowledgements have been received as indicated by step 216. If a single acknowledgment is received, controller 34 generates control signals directing transceiver 32 to communicate or transmit signals assigning the current assignment value (AV) to the particular object as its address or object identifier (ID) as indicated by step 218. As indicated by step 220, the assignment value (AV) is incremented by 1 so that each object is assigned a distinct value for its object identifier. Once an assignment value has been assigned and communicated per step 218 and the assignment value has been incremented per step 220, controller 34 generates control signals directing transceiver 34 to continue to poll by transmitting commands to any objects having the null object identifier value once again per step 212.

If controller 34 determines that a single acknowledgment has not been received, but that multiple acknowledgements have been received in step 216, controller 34 generates control signals directing transceiver 32 to transmit commands to each of the responding objects instructing such objects to "sleep" for different periods of time during which such objects are inactive and cannot respond to signals or commands from assignment system 14 as indicated by step 222. Upon awakening or becoming active at different times, assignment system 14 will once again attempt to assign each object with a distinct object identifier value.

According to one exemplary embodiment, each object 16-22 has a rolling multi-bit binary register having a single positive bit such as 00000001. At a particular rate, the positive bit changes locations or rolls (for example, 00000001, to 00000010, to 00000100, etc). Upon receiving a command requesting an acknowledgment, controller 56 (shown in FIG. 1) of each object is configured to respond by transmitting an acknowledgment comprising the current value in the multi-bit register. For example, an acknowledgment may compare transmission of a pulse of visual light, infrared light, etc. If the value received by assignment system 14 includes two or more positive bit values (e.g., 00000011 that may be represented by two or more individual pulses), controller 34 concludes that a single acknowledgment has not been received per step 216. In such embodiment, controller 34 then generates control signals causing transceiver 32 to direct all objects to sleep or become inactive for a period of time based upon the value of the multi-bit acknowledgment signal that was initially transmitted by the particular object. For example, controller 34 may instruct objects to sleep 10 micro seconds for each value contained in the multi-bit register. An object transmitting an acknowledgment signal of 00000001 will be instructed to sleep 10 micro seconds while another object transmitting an acknowledgment signal of 00000010 will be instructed to sleep 20 micro seconds. Because such objects will awaken at different times, such objects will be assigned distinct object identifier values.

FIG. 3B illustrates the steps carried out by objects 16-22 to automatically reset addresses or object identifier values to the null object identifier value when such objects are no longer being used as part of an application. As indicated by steps 230, 231 and 232 in FIG. 3B, each object 16-22 includes a timer which is continually incremented until time T exceeds a predetermined threshold value X. As indicated by step 234, once time T has exceeded the threshold value X, the address or object identifier value contained within memory 52 (shown in FIG. 1) is automatically reset to the null object identifier value (0 in the example). Thereafter, the timer is reset. In one exemplary embodiment, the minimum threshold value X is set at 4 seconds. In other embodiments, other minimum threshold values may be utilized.

FIG. 3C is a flow chart illustrating steps performed by assignment system 14 in resetting the timer of each of the objects that are being used as part of an application such that the addresses or object identifier values of such objects are maintained. As indicated by steps 240, 242, 244 and 249, controller 34 generates control signals directing transceiver 32 to transmit command signals to objects having an address or object identifier value N until a response or acknowledgment is received. For example, a command will first be transmitted requesting acknowledgment from an object having an object identifier value of 1. If no acknowledgment is received, assignment system 14 will subsequently transmit a command signal requesting acknowledgment from an object having an object identifier value of 2 and so forth. Upon receiving acknowledgment (ACK), controller 34 determines whether a single acknowledgment has been received as indicated by step 246. If a single acknowledgment has been received, controller 34 generates control signals directing transceiver 32 to transmit control signals to the particular object instructing the particular object to reset its timer (T=0) as indicated by step 248. Thereafter, assignment system 14 will continue polling objects having other object identifier values per steps 249 and 242.

If multiple acknowledgment responses are received, controller 34 generates control signals directed to transceiver 32 to transmit a command to all responding objects having the object identifier value N instructing such objects to reset their object identifier value as a null object identifier value (0 in the example) and to sleep or become inactive for different periods of time. Upon awakening or becoming active at their distinct moments in time, such objects will be assigned new object identifier values per the steps described with respect to FIG. 3A. The steps outlined in FIG. 3C that are carried out by assignment system 14 (shown in FIG. 1) identify and address situations where multiple objects have been assigned the same object identifier value.

According to one exemplary embodiment, each object includes a rolling multi-bit register having a single positive bit. Upon receiving an acknowledgment request per step 242, such objects transmit the value contained within the rolling multi-bit register as the acknowledgment response. If controller 34 (shown in FIG. 1) receives an acknowledgment signal having greater than 1 positive bit (e.g., 00000011), controller 34 concludes that more than a single acknowledgment has been received, indicating that two objects have the same object identifier value N. As a result, controller 34 resets the values of all such objects to the null object identifier value and instructs such objects to sleep for a period of time based upon the values of the acknowledgment signals transmitted by such objects. For example, in one embodiment, controller 34 may be configured to instruct objects to sleep 10 micro seconds for each value. A first object transmitting an acknowledgment response having a multi-bit value of 00000001 will be instructed to sleep 10 micro seconds while a second object having a multi-bit value of 00000010 will be instructed to sleep 20 micro seconds. In other embodiments, controller 34 may be configured to instruct such objects to sleep or go inactive for different periods of time using other techniques.

Figure 4:
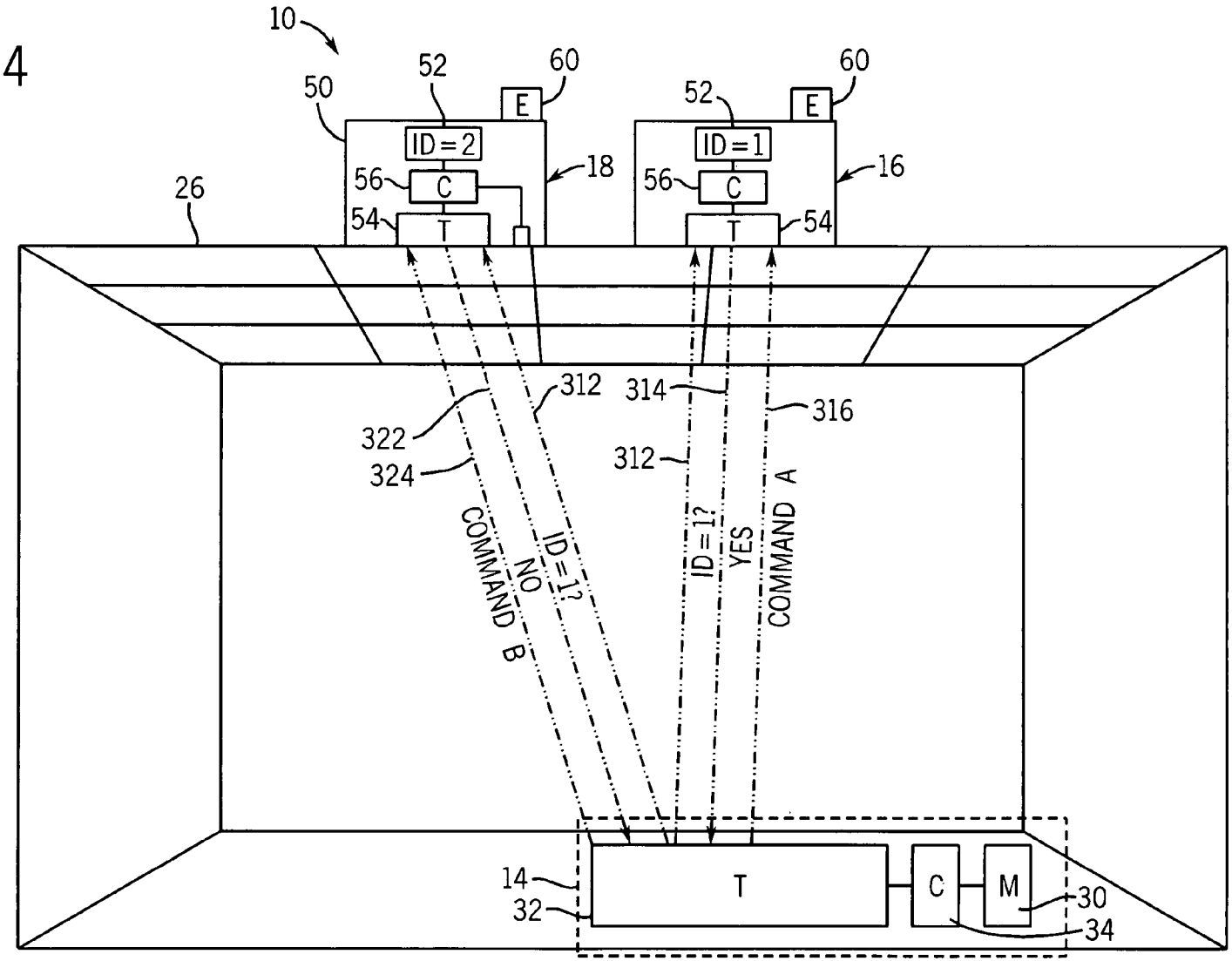
FIG. 4 is a schematic illustration of the system of FIG. 1 depicting use of object identifiers to address commands to objects according to one exemplary embodiment.

FIG. 4 schematically illustrates system 10 utilizing the distinct object identifiers recorded in memory 52 of objects 16 and 18 to distinguish between objects 16 and 18 and to address individual commands to objects 16 and 18. In particular, FIG. 4 illustrates assignment system 14 communicating inquiries via signals 312 to both objects 16 and 18 which have recorded object identifier values of 1 and 2, respectively. FIG. 4 illustrates object 16 responding by transmitting signal 314 to assignment system 14 indicating that object identifier 1 is recorded in its memory 52. Upon receipt of signal 314, controller 34 causes transmitter 32 to communicate signal 316 to object 16 providing object 16 with command A.

As further illustrated by FIG. 4, object 18 responds to signal 312 by transmitting signal 322 indicating that object identifier 1 is not recorded in memory 52 of object 18. In response to receiving signal 322, controller 34 of system 14 generates control signals causing transceiver 32 to transmit signal 324 including command B for object 18. Commands A and B may result in objects 16 and 18 operating in distinct fashions. In one embodiment, objects 16 and 18 may be identical to one another and configured to perform multiple functions. The distinct object identifiers associated with objects 16 and 18 enable system 14 to issue distinct commands to objects 16 and 18 to perform such distinct functions. For example, in one embodiment, objects 16 and 18 may include speakers configured to emit music or sound over multiple channels utilizing the distinct object identifiers recorded in memory 52 of objects 16 and 18, system 14 may command object 16 to emit sound or music over a first channel while commanding object 18 to emit sound or music over a second distinct channel.

FIG. 6 schematically illustrates object identification and control system 410, another embodiment of system 10 shown and described with respect to FIG. 1. System 410 generally includes main unit 412, assignment system 414 and objects 416, 417, 418, 419, 420, 421 and 422. Main unit 412 comprises an interactive electronic device configured to provide interactive use of objects 416-422 in one or more applications. Main unit 412 includes screen 425, display generation system 427 and position detection system 429. Screen 425 comprises a member having a surface 426 upon which objects 416-422 may be placed. Screen 425 is further configured to cooperate with display generation system 427 to form a display or an image upon surface 426. In the example shown, screen 425 is supported and arranged in a substantially horizontal orientation. In other embodiments, screen 425 may alternatively be inclined, declined or vertical. In other embodiments, screen 425 may be concave or convex. In addition to facilitating the positioning of objects 416-422 upon surface 426, screen 425 may also be configured to be touched by one or more user's fingers or other devices for inputting information or interacting with system 410.

Display generation system 427 comprises one or more devices configured to cooperate with screen 426 so as to form a visual image or display upon surface 426. According to one embodiment, screen 425 comprises frosted glass while display generation system 427 comprises a projector configured to project a display at screen 425. In one embodiment, screen 425 may comprise a screen commercially available from Day Lite Screen Company of Warsaw, Ind., under the trade name DA-100. In one embodiment, display generation system 427 may include a digital light processing (DLP) projector. In another embodiment, display generation system 427 may comprise other projectors.

Position detection system 429 comprises one or more devices configured to identify or detect the positioning of objects 416-422 upon surface 426 of screen 425. According to one embodiment, position detection system 429 comprises a back vision system in which position detection system 429 takes snapshots of light or other electromagnetic radiation that passes around objects 416-423 and through screen 425 or that is reflected off of objects 416-423 resting upon screen 425 at distinct moments in time. By subtracting one image at a first moment in time from another image at a second moment in time, system 429 may detect both the positioning of any objects upon screen 425 as well as movement of objects 416-422 over time. In other embodiments, position detection system 429 may detect the position and movement of objects 416-422 relative to surface 426 with other techniques and devices.

Identifier assignment system 414 is similar to identifier assignment system 14 shown and described with FIG. 1. For ease of illustration, those components of system 414 which correspond to similar components of system 14 are numbered similarly. In the particular example shown, controller 34 is additionally configured to generate control signals directing the operation of display generation system 427 and position detection system 429 as well as to perform any analytical tasks required of systems 427 and 429. In other embodiments, distinct controllers may be provided for one or both of systems 427 and 429.

Objects 416-422 are similar to objects 16-22 (described and illustrated with respect to FIG. 1) except that multiple identifier fields are stored in memory 52 of each object 416-422 and each object 416-422 additionally includes a position indicating emitter 433. Those remaining components of each object 416-422 which correspond to the components of objects 16-22 are numbered similarly. As shown by FIG. 4, memory 52 of each object 416-422 includes an application identifier field 435, a type identifier field 437 and an object identifier field 439. The application identifier field 435 is configured to store an application identifier indicating the particular application, such as a game, program or the like, for which a particular object may be used. According to one embodiment, application identifier field 435 may comprise a separate portion of memory 52 (i.e., another form or type of memory) that is non-volatile in nature such that if a particular object is removed from screen 425, then later reset upon screen 425, assignment system 414 may identify the particular object even though its object identifier field has changed. The type identifier field 437 is a species of the application field 435 and is configured to store a type identifier indicating the type of the associated object in an application where multiple types of objects may be used. The object identifier field 439 comprises a field configured to store an object identifier distinguishing the particular object from other objects which may be of the same type and may be used for the same application. For example, in one application, such as checkers, the application identifier field 435 may be used to store an application identifier which indicates that a particular object is to be used for the application of checkers versus chess. The type identifier field 437 may be used to store a type identifier indicating whether the particular object is of a first type checkers piece, black, or of a second type of checkers piece, white. The object identifier field 439 may be used to store an object identifier value distinct from other values assigned to other checker pieces to enable checker pieces to be distinguished from one another and to enable distinct commands to be issued to selected objects (checker pieces).

Emitter 433 of each of objects 416-422 comprises a component associated with each object that is configured to emit a signal to assist position detection system 429 in identifying the position of a particular object 416-422 having a particular identifier. In other words, emitter 433 emits a signal that assists position detection system 429 to identify the location of one of a multitude of objects upon screen 425 that has been assigned a particular object identifier value, such as 1, even though the multiple objects have identical configurations. As further shown by FIG. 5, position detection system 429 includes a receiver 453 configured to receive the signal emitted by emitter 433. For example, in one embodiment, emitter 433 may comprise a light emitter, such as one or more LEDs, while receiver 453 comprises an optical sensor such as a camera. In embodiments where position detection system 429 detects the positioning and movement of objects using image subtraction, receiver 453 may comprise the same camera or other light sensitive device that is already provided. In other embodiments, emitter 433 may comprise an infrared emitter, wherein receiver 453 is configured to receive and sense the emission of infrared electromagnetic waves by emitter 433. In still other embodiments, emitter 433 may be configured to emit other signals such as vibration, a magnetic field, a temperature rise or decrease and the like, wherein receiver 453 is configured to sense the vibration, the magnetic field, the electrical charge, or the temperature variation.

In operation, controller 34 generates control signals directing transmitter 32 to transmit signals to each of the objects upon screen 425 instructing the particular object assigned a particular option identifier to emit a signal which is received and detected by position detection system 429. In this manner, position detection system 429 may determine the position of the particular object assigned object identifier.

Figure 5:
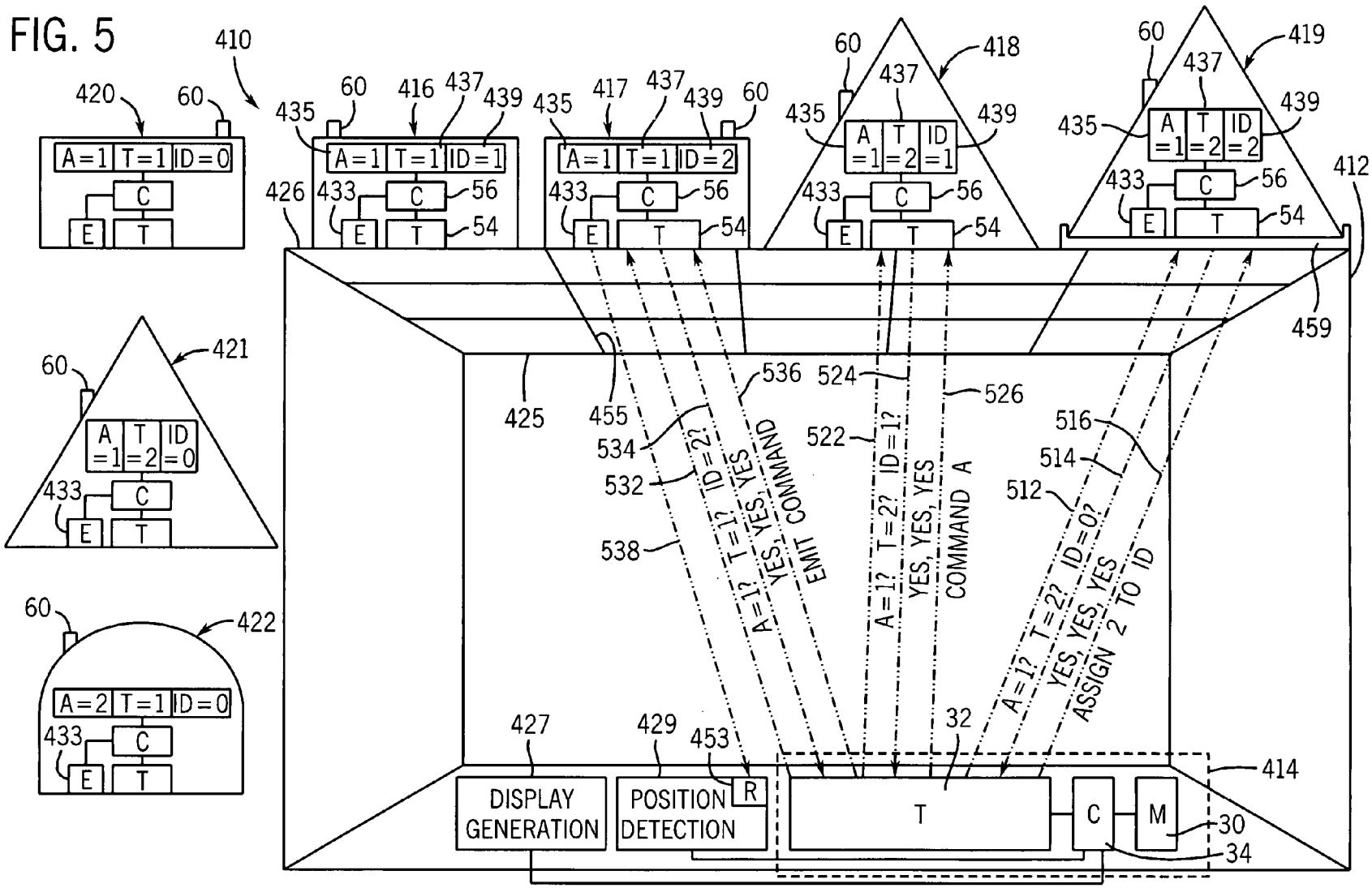
FIG. 5 is a schematic illustration of another embodiment of the object identification and control system of FIG. 1.

FIG. 5 further illustrates one example scenario or mode of operation for system 410. In particular, FIG. 5 illustrates controller 34 generating control signals directing display generation system 427 to form an image 455 upon surface 426 of screen 425. Image 455 comprises a matrix dividing the surface of screen 425 into distinct rectangular sectors. In other scenarios, display generation system 427 may form various other images upon screen 425.

FIG. 5 further illustrates the positioning of objects 416, 417, 418 and 419 upon screen 425 while objects 420, 421, and 422 are withdrawn from screen 425 and are not being used as part of an application. Objects 416, 417 and 420 are identical to one another and are configured for use in the same application. As a result, each of objects 416, 417 and 420 have the same application identifier in the application identifier field 435 and the same type identifier (1) in the type identification field 437. As shown in FIG. 5, objects 416 and 417 have been placed in use in the particular location and have been assigned distinct object identifier values (1, 2) by system 414. Object 420 is withdrawn and not in use and has the null identifier value of zero recorded in its object identifier field 439.

Objects 418, 419 and 421 are identical to one another but are distinct from objects 416, 417 and 420. Because objects 418, 419 and 421 are also configured for use in the same application as objects 416, 417 and 420, objects 418, 419 and 421 have the same application identifier in application identifier field 435 as objects 416, 417 and 420 but have different type identifier values (2) in type identifier fields 437. Objects 418 and 419 have been recognized by system 414 as being in use and have been assigned distinct object identifier values (1, 2). Object 421 has not been recognized by system 414 and is not in use, resulting in object 421 having the null object identifier value (0) in its object identifier field 439.

Object 422 is different from each of the remaining objects 416-421 and is configured for use in a different application. As a result, object 422 has a distinct application identifier (2) in its application identifier field 435. The distinct value in application identifier field 435 of object 422 may be used to distinguish object 422 from the remaining objects 416-421 so that object 422 will not be used in the same application as the remaining objects 416 and 421. As a result, the application identifier field 435 may be used so that authorized or appropriately configured objects are used in a particular application.

FIG. 5 further illustrates system 414 communicating with objects 417, 418 and 419. In the example scenario illustrated, controller 34 directs transceiver 32 to transmit signal 512 asking each object upon screen 425 whether it has values of 1, 2 and 0 (the null value) in its application field 435, type field 437 and object identifier field 439, respectively. For ease of illustration, although signals 512 are also transmitted to objects 416, 417 and 418, such signals and the subsequent responses are not shown. Having such values in its memory 52, object 419 responds with signal 514. System 414 responds to signal 514 by transmitting signal 516 assigning an object identifier value of 2 which is recorded in object identifier field 439 of object 419.

Once object 419 has been assigned object identifier value 2 and this assignment has been communicated to object 419 via signal 516, controller 34 further generates control signals directing display generation system 427 to modify image 455 to indicate and confirm to the person that object 419 has been recognized by system 414 and has now been assigned a unique or distinct address or identifier. In the particular example shown, display generation system 427 modifies image 455 to form an image box, ring, square, or other shape 459 and extends adjacent to object 419. In particular embodiments, indicator image 459 may be utilized in lieu of indicator 60 associated with objects 416-422.

As further shown by FIG. 5, object 418 has already been assigned an object identifier value of 1 which has been recorded in its object identifier field 439. System 414 utilizes the assigned object identifier value of 1 to distinguish object 418 from object 419. In particular, system 414 initially transmits signal 522 asking each of objects 416419 whether the particular object has values of 1, 2 and 1 in its application identifier field 435, type identifier field 437 and object identifier field 439, respectively. For ease of illustration, the signal transmitted to and the response from object 418 are illustrated. In response, object 418 transmits signal 524, informing system 414 that object 418 meets the requested criteria. As a result, system 414 transmits signal 526 includes command A for the object 418.

FIG. 5 further illustrates system 414 identifying the positioning of the particular object having type identifier value of 1 and an object identifier value of 2. In particular, FIG. 5 illustrates system 414 transmitting signal 532 asking each of the objects upon screen 425 which particular object has values of 1,1 and 2 in the application identifier field 435, the type identifier field 437 and the object identifier field 439, respectively. For ease of illustration, signals transmitted to object 417 and its response are illustrated. Object 417 responds by transmitting signal 534. As a result, system 414 transmits signal 536 instructing controller 56 of object 417 to direct emitter 433 to emit signal 538. Receiver 453 of position detection system 429 receives signal 538 to identify the position of the particular object that is configured for application 1, that is type 1, and that has been assigned object identifier 2, object 417.

Overall, system 410 provides an interactive device that generates an image upon screen 425, that identifies and tracks the position or movement of objects upon screen 425 and that distinguishes between multiple objects with distinct addresses or identifiers assigned to each object that is being used. Like system 10 (shown and described with respect to FIG. 1), system 410 facilitates the addition of new objects or the replacement of objects by assigning distinct identifiers to objects as particular objects are recognized by the system and are put into use in a particular application. This dynamic assignment of identifiers to objects simplifies the manufacture of objects by reducing or eliminating the need to assign distinct object identifier values during the manufacture of objects. The dynamic identification assignment scheme further reduces the likelihood that two objects in an application may accidentally be assigned the same identifier or address.

Although the foregoing has been described with reference to example embodiments, workers skilled in the art will recognize that changes may be made in form and detail without departing from the spirit and scope of thereof. For example, although different example embodiments may have been described as including one or more features providing one or more benefits, it is contemplated that the described features may be interchanged with one another or alternatively be combined with one another in the described example embodiments or in other alternative embodiments. Because the disclosed technology is relatively complex, not all changes in the technology are foreseeable. The present subject matter described with reference to the example embodiments and set forth in the following claims is manifestly intended to be as broad as possible. For example, unless specifically otherwise noted, the claims reciting a single particular element also encompass a plurality of such particular elements.

What is claimed is:

1. A method comprising:

recording a first object identifier in a first memory associated with and carried by the first object;

recording a second object identifier in the first memory in place of the first object identifier;

recording the first object identifier in the first memory in place of the second object identifier in response to the first object having a predetermined spatial relationship to the assignment system; and recording the first object identifier in the first memory in place of the second object identifier, wherein the first object identifier is recorded in the first memory in place of the second object identifier in response to the first object being removed from a screen.

2. A non-transitory processor readable medium comprising:

stored instructions for recording a first object identifier in a first memory associated with a first object;

stored instructions for recording a second object identifier in the first memory in place of the first object identifier; and stored instructions for recording the first object identifier in the first memory in place of the second object identifier in response to the first object failing to receive a renewal signal for a predetermined period of time.

3. The processor readable medium of claim 2 further comprising:

stored instructions for recording a third object identifier in a second memory associated with a second object; and stored instructions for recording a fourth object identifier distinct from the second object identifier and the third object identifier in the second memory in place of the third object identifier.

4. The non-transitory processor readable medium of claim 2 further comprising stored instructions for assigning the second object identifier to the first object in response to the first object being placed upon a screen.

5. The non-transitory processor readable medium of claim 2, wherein the first memory is carried by the first object.

6. A method comprising:

recording a first object identifier in a first memory associated with and carried by the first object;

recording a second object identifier in the first memory in place of the first object identifier;

recording the first object identifier in the first memory in place of the second object identifier in response to the first object having a predetermined spatial relationship to the assignment system;

positioning a plurality of objects, including the first object, adjacent to a screen, each of the plurality of object having an associated memory;

recording a distinct identifier in the memory of each of the plurality of objects as it is positioned adjacent to the screen, wherein the second object identifier for the first object is distinct from other identifiers recorded in memory of other of the plurality of objects; and erasing or replacing the first object identifier in the memory of the first object while the first object is withdrawn from the screen, wherein the first object identifier is erased or replaced in response to be first object being withdrawn from the screen for a predetermined period of time.

7. A method comprising:

recording a first object identifier in a first memory associated with a first object;

recording a second object identifier in the first memory in place of the first object identifier; and recording the first object identifier in the first memory in place of the second object identifier in response to the first object failing to receive a renewal signal for a predetermined period of time.

8. The method of claim 7, wherein the first memory is carried by the first object.

* * * * *

UNITED STATES PATENT AND TRADEMARK OFFICE

CERTIFICATE OF CORRECTION

PATENT NO. : 8,803,894 B2
APPLICATION NO. : 11/105903
DATED : August 12, 2014
INVENTOR(S) : Shivji It is certified that error appears in the above-identified patent and that said Letters Patent is hereby corrected as shown below:

In the Claims

Column 13, line 40, Claim 3, after "The" insert -- non-transitory --.

Signed and Sealed this
Twenty-fifth Day of November, 2014

Michelle K. Lee

Michelle K. Lee
*Deputy Director of the United States Patent and Trademark Office*